United States Patent [19]

Hallberg et al.

[11] 4,231,335

[45] Nov. 4, 1980

[54] CONTROL SYSTEM FOR REGULATING AIR/FUEL RATIO

[75] Inventors: Irving H. Hallberg; Howard C. Paul, both of Des Plaines; Ronald R. Ralston, Elmhurst; Roy E. Hunninghaus, Des Plaines, all of Ill.

[73] Assignee: Borg-Warner Corporation, Chicago, Ill.

[21] Appl. No.: 27,649

[22] Filed: Apr. 6, 1979

Related U.S. Application Data

[63] Continuation of Ser. No. 797,159, May 16, 1977, abandoned.

[51] Int. Cl.[3] ..... F02M 7/18

[52] U.S. Cl. ..... 123/440; 123/489

[58] Field of Search ..... 123/32 EE, 119 EC, 119 R, 123/119 D, 32 EA; 60/276, 285

[56] References Cited

U.S. PATENT DOCUMENTS

| | | | |
|---|---|---|---|
| 2,389,797 | 11/1945 | MacNeil et al. | 123/32 EE |
| 2,391,291 | 12/1945 | Bollo et al. | 123/32 EE |
| 3,841,283 | 10/1974 | Wood | 123/119 R |
| 3,927,304 | 12/1975 | Wentworth et al. | 123/32 EE X |
| 3,960,118 | 6/1976 | Konomi et al. | 123/32 EE |
| 4,007,718 | 2/1977 | Laprade et al. | 123/32 EE X |
| 4,036,186 | 7/1977 | Hattori et al. | 123/119 R X |
| 4,056,932 | 11/1977 | Nakamura et al. | 123/119 R X |
| 4,083,337 | 4/1978 | Hattori et al. | 123/32 EE X |

*Primary Examiner*—Tony M. Argenbright
*Attorney, Agent, or Firm*—James J. Jennings

[57] ABSTRACT

In a system including a carburetor for regulating the air/fuel ratio fed to an internal combustion engine, a sensor is positioned in the exhaust pipe to provide a control signal indicating the amount of some exhaust gas constituent, such as oxygen. A control circuit is provided to regulate the position of a carburetor component, to change the air/fuel ratio as a function of the control signal derived from the exhaust gas sensor. This carburetor component is continually displaced, either toward a richer or leaner mixture condition, thus in effect integrating the signal from the exhaust gas sensor which ultimately regulates the air/fuel ratio. Operation of the control circuit is modified as a function of the engine speed and the engine temperature.

5 Claims, 4 Drawing Figures

CONTROL SYSTEM FOR REGULATING AIR/FUEL RATIO

This is a continuation, of application Ser. No. 797,159 filed May 16, 1977, now abandoned.

BACKGROUND OF THE INVENTION

There is a great deal of art depicting the various approaches to regulating the air flow and/or amount of fuel metered through a carburetor to an internal combustion engine. The reason for such control is that the air/fuel mixture is improved by control, as compared to a fixed schedule of air/fuel mixture, because engine operating conditions change, air density changes (as a function of temperature, barometric pressure and altitude), and the fuel composition changes. The better the regulaton of the air/fuel ratio, the more efficient the engine operation and the more economical is the cost of operation. The engine can be run on a leaner mixture if it is precisely and quickly regulated. However most of the systems previously developed are unduly complex, and thus expensive, in construction and operation. The more complicated the circuitry and transducer arrangements, the more potential there is for a shortened mean time between component failure, with consequent expense and unavailability of the vehicle during repair.

It is therefore a primary object of the present invention to provide a system for regulating the air/fuel ratio delivered to an internal combustion engine which is simpler and more efficient than earlier known systems.

A related object of the invention is to provide such a system which accommodates a change in system operation in accordance with the operating speed of the engine.

Yet another important object of the invention is to provide such an arrangement in which the control system is modified in its operation during vehicle start-up to ensure a rich mixture is available at that time.

SUMMARY OF THE INVENTION

The control system of the invention is useful for regulating the air/fuel ratio of the mixture delivered to an engine in which the fuel is virtually completely burned, and the products of combustion are discharged through an exhaust conduit. The control system comprises a sensor positioned to contact the exhaust gas and to develop an electrical control signal which varies as a function of the proportion of at least one component gas in the discharged exhaust gas mixture. A control actuator is positioned for movement to regulate the air/fuel ratio. A control circuit is connected to receive the control signal and, in accordance with this invention, to continually displace the control actuator as a function of the control signal. The control circuit regulates the rate of control actuator displacement as a function of engine speed. The air/fuel ratio is thus continually adjusted toward a richer or leaner mixture, in accordance with the instantaneous value of control signal. This produces an optimum stoichiometric ratio value of the air/fuel ratio.

THE DRAWINGS

In the several figures of the drawings, like reference numerals designate like components, and in those drawings.

GENERAL SYSTEM DESCRIPTION

Figure 1:
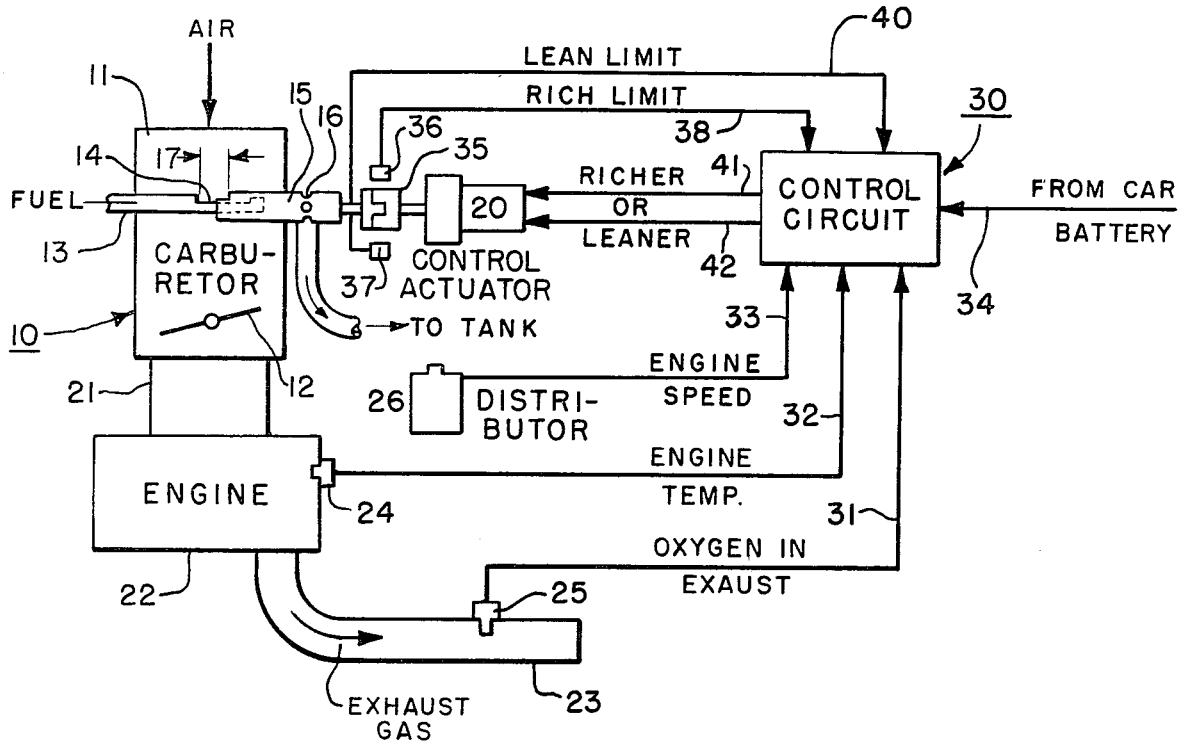
FIG. 1 is a block diagram depicting the control system of the present invention in conjunction with a carburetor and internal combustion engine.

FIG. 1 shows major components of a control system suitable for use in regulating the air/fuel ratio of the mixture delivered to an engine in a conventional vehicle such as a car. Those skilled in the art will readily appreciate that the invention is applicable to other types of vehicles, such as snowmobiles, and even vehicles such as power boats which are not limited to operation on land. In general the invention is applicable to engine-driven units in which the ratio of fuel to air is determined in a mixing device such as a carburetor, and in which the exhaust gas is analyzed in some manner to provide for adjustment of the mixing device.

In FIG. 1, the mixing is accomplished in a carburetor 10 which receives air at its upper input section 11 from the conventional air intake (not shown). In the illustrated arrangement, the carburetor has a throttle plate 12, of the type usually connected to have its position varied as a function of the accelerator pedal position. Above the throttle plate is a charge forming arrangement in the carburetor, including a fuel jet tube 13 which is cut out to define a slot 14. The extremity of the tube 13, including a portion of the cut-out slot 14, extends into a cylindrical receiver 15, which itself defines an opening 16 as shown. In operation, gasoline is pumped from the tank (not shown) to input jet 13. The fuel passes from the input jet tube 13 to the receiver 15, and the relative positions of the tube and receiver determine the effective opening or extent of the "notch" 17 thus determining the amount of fuel exposed to the incoming air flow. The fuel which enters the receiver 15 passes through the opening 16 into a return conduit; some of the returned fuel enters the idle orifice path, and the remainder is returned to the tank, in a manner illustrated in FIG. 11 of U.S. Pat. No. 3,785,627, entitled "Charge Forming Apparatus", which issued to the assignee of this invention on Jan. 15, 1974. In that figure the lower throttle plate 182 corresponds to throttle plate 12 in FIG. 1 of this application, and the showing of the nozzle 152 and receiver 153 in the patent corresponds generally to the jet tube-receiver members 13, 15 in FIG. 1 of this application. In the arrangement of the patent the relative positions of the nozzle and receiver were adjusted by inserting a screwdriver or similar tool into the slot 206 to vary the position of the threaded portion 207 and thus of the receiver itself.

Figure 2:
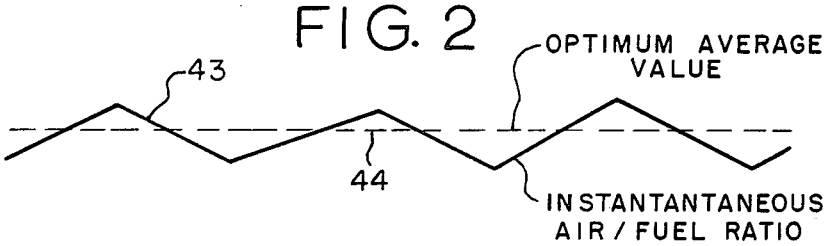
FIG. 2 is a graphical illustration useful in understanding operation of this invention.

In accordance with the present invention, a control system is provided to regulate the relative positions of the receiver and jet tube automatically, as a function of at least one component sensed in the discharged exhaust gas. This is accomplished by a continuous adjustment of the receiver-jet tube relative positions, continually driving a servo motor 20 coupled to the receiver to establish an average value of the notch 17, and thus maintain an optimum average value of the air/fuel ratio. In FIG. 2 the optimum average value is represented by broken line 44. Curve 43 depicts the instantaneous value of the air/fuel ratio as it varies about the optimum value.

The fuel/air mixture from the carburetor 10 passes downwardly through the manifold section 21 into the engine 22, where it is compressed, ignited and burned. The products remaining after combustion are discharged through the exhaust 23. The temperature within the engine block is sensed by a sensor 24, and another sensor 25 is positioned with at least a portion extending into the exhaust conduit 23. The sensor 25 is of the type which develops an electrical control signal varying, in at least one characteristic, as a function of the presence of at least one component in the exhaust gas mixture. One such sensor commercially available provides an electrical signal which is related to the amount of oxygen in the exhaust gas, and provides an output voltage varying in amplitude as a function of the amount of oxygen sensed. The other operating information, related to engine speed, is derived from the distributor 26.

A control circuit 30 is coupled between the exhaust gas sensor 25 and the control actuator 20. Control circuit 30 receives an electrical control signal over line 31 from the sensor 25, indicating the amount of oxygen or some other gas constituent in the discharged gas. The control circuit also receives another electrical signal over line 32 which is related to the engine temperature, and, over line 33, a third electrical signal which is a function of the engine speed. Energy to power the control circuit 30 is received over line 34 from the vehicle battery.

The control actuator or servomotor 20 is joined through coupling 35 to the receiver 15. As the coupling 35 rotates, a cam on the back side (not visible) is positioned to trip either a rich limit switch 36 at one extreme of the control actuator travel, or a lean limit switch 37 at the other extreme of the angular displacement. When rich limit switch 36 is closed, a signal is passed over line 38 to the control circuit 30. Similarly when the lean limit switch 37 is engaged, a signal is provided over line 40 to the control circuit. Depending upon the different input signals, control circuit 30 is connected to provide either a drive-richer signal on lines 41 and 42, or a drive-leaner signal (by reversing the polarity of the signal on lines 41 and 42) to the control actuator at all times, so that this actuator is displacing the receiver and constantly adjusting the air/fuel ratio.

This constant driving of the control actuator 20 is a significant departure from prior art systems, which generally employ some type of integrating circuit to establish a control signal, which signal is thereafter used to drive the motor or actuator toward a preferred location. Instead, the present invention always drives the actuator not only toward but past the optimum location, until the direction of actuator drive is reversed and it is driven past the average value in the opposite direction, and this cycling is continued. This allows the integration to be done, in effect, by the oscillation of the servomotor, rather than the addition of control circuitry prior to the control actuator of the system.

DETAILED DESCRIPTION OF THE INVENTION

Figure 3:
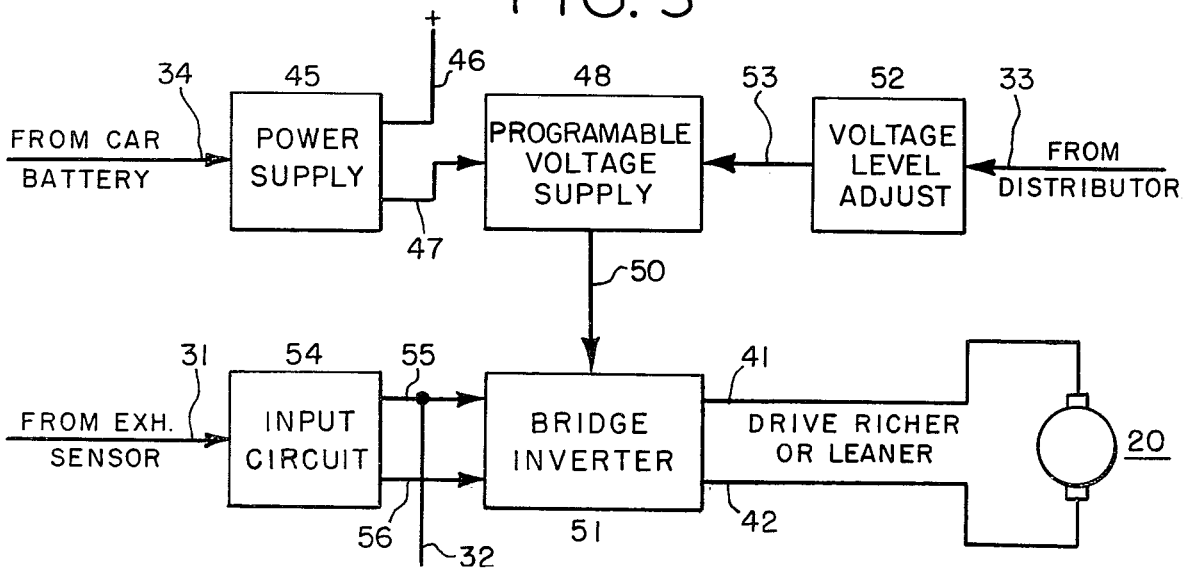
FIG. 3 is a block diagram of major subsystems of the control circuit of the invention, shown as a single block in FIG. 1.

FIG. 3 depicts major subcircuits of the control circuit of the invention. Energy received from the car battery over line 34 is passed to the power supply stage 45, which provides a fixed energization voltage over line 46 to power the remaining subcircuits in the control circuit, and likewise passes the energizing voltage over line 47 to a programmable voltage supply stage 48. The level of the output voltage from stage 48 is passed over line 50 to the bridge inverter circuit 51, and the level of the voltage on line 50 determines the rate at which the control actuator is driven. This rate is determined by the voltage level adjust circuit 52, which receives the speed-indicating signal from the distributor (or from other suitable point) over line 33, and produces a modifying signal which is passed over line 53 to regulate operation of the adjustable voltage circuit 48.

Figure 4:
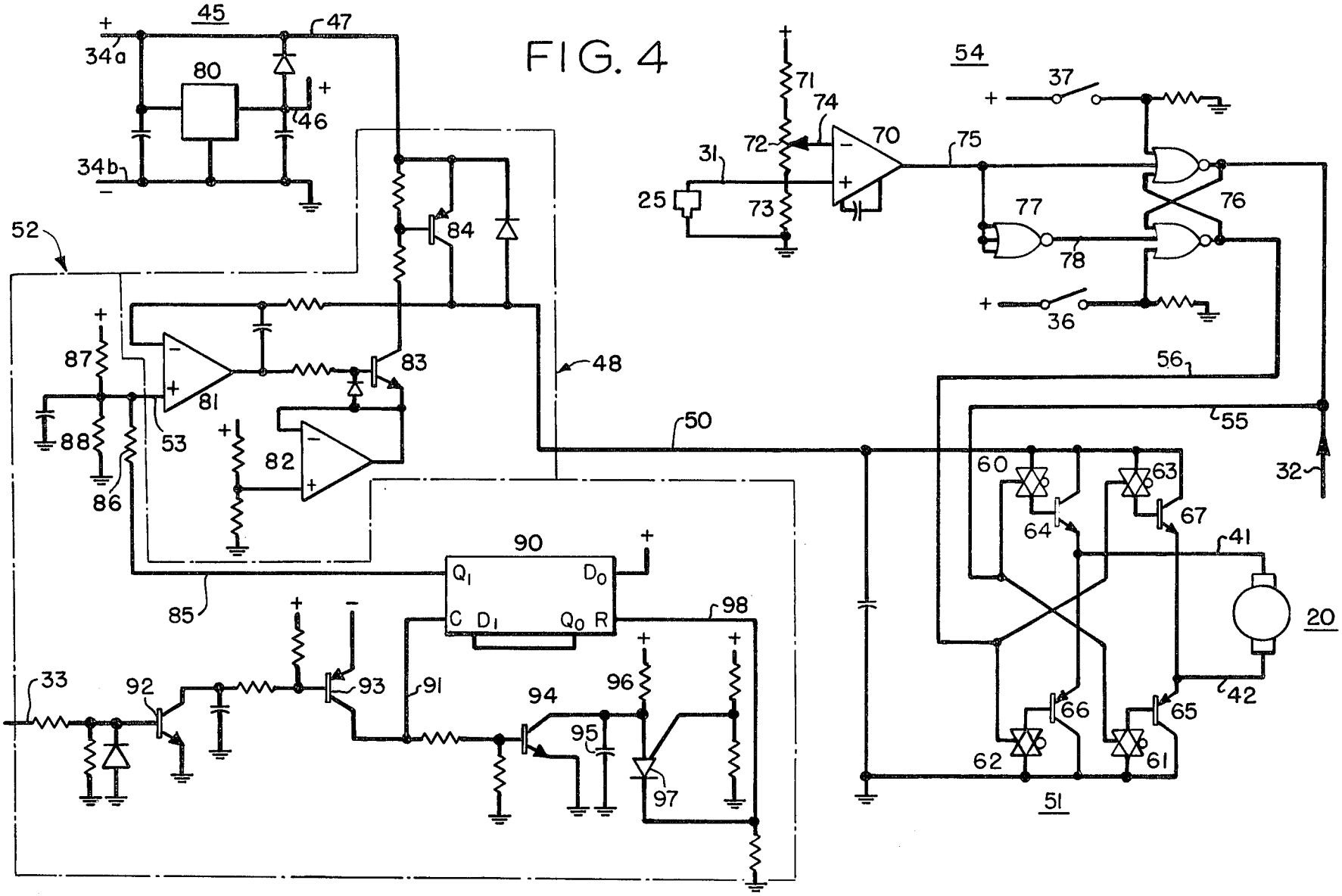
FIG. 4 is a schematic diagram, setting out circuit details of the equipment shown more generally in FIGS. 1 and 3.

The exhaust gas sensor signal on line 31 is passed to an input circuit 54, which operates on this signal to maintain either a drive-rich signal on line 55 or a drive-lean signal on line 56; one of these signals is always supplied to the bridge inverter circuit 51. During start-up a drive-rich signal is supplied over line 32, and at this time the signal on line 32 insures a rich mixture is supplied while the engine warms up. Broadly the bridge inverter circuit is a switching means, operable to provide continuously either a richer or leaner signal on the output lines 41 or 42, and to provide a rate of actuator angular displacement which is a function of the signal received over line 50. As the actuator was a d-c servo motor in a preferred embodiment, the drive-richer signal on lines 41 and 42 actually means current flows from line 41 through the servo motor 20, and is returned over line 42. For a drive-leaner signal, current flows from line 42 through actuator 20, and is returned over line 41. With this general perspective of the system, the circuit details will be described in connection with FIG. 4.

As there shown, the servo motor 20 is energized by gating on various ones of the four switches 60-63, which in turn regulate the conduction of their associated transistors 64-67. The switches 60-63 in the illustrated embodiment were analog-gate transmission switches, each being $\frac{1}{4}$ of a 4016 device. In the illustrated embodiment a drive-richer signal on line 55 gates on the switches 60, 61, which in turn gate on their associated transistors 64 and 65. This completes a path for current flow from energizing line 50 through the collector-emitter path of transistor 64, conductor 41, drive motor 20, conductor 42, and the emitter-collector path of transistor 55 to ground. This drives the receiver 15 (FIG. 1) in the appropriate direction to increase the effective width of the notch 17 and provide a richer air/fuel mixture. In a similar manner, a drive-leaner signal on line 56 energizes the switches 62, 63 and turns on the transistors 66 and 67, driving servo motor 20 in the opposite direction toward a leaner air/fuel mixture.

The input circuit 54 receives an electrical control signal on line 31 which varies as a function of the amount of oxygen in the discharge gas mixture. The sensor 25 can be a commercially available platinum plated zirconium dioxide unit, mounted near the engine exhaust manifold. Such a unit produces an output voltage of approximately 0.8 volt when the air/fuel mixture is richer than stoichiometric (approximately 14.5:1), and this output voltage drops very rapidly to approximately 0.1 volt when the air/fuel mixture is leaner than this stoichometric ratio. This control signal on line 31 is passed to the plus input connection of an operational amplifier 70, which in an embodiment built and tested was a CA3130. A voltage divider circuit comprises a resistor 71, a potentiometer 72, and another resistor 73, all connected between the plus voltage supply and ground as shown, to provide an adjustable signal on line 74 to the op amp. This allows the trip level or switching point to be adjusted, that is, the level at which the op amp will switch from a "0" or low level output signal (denoting drive-rich) to a "1" or high-voltage level signal (denoting drive-lean). The signal from op amp 70 is passed over line 75 both to a flip-flop 76 and an inverter 77. Flip-Flop 76 included two parts of a 4025 circuit connected as shown, and the inverter used another of the 4025 sections to provide a signal on line 78 which is the inversion of that on line 75. The provision of the flip-flop 76 is in the nature of an interlock, to be certain that output signals cannot appear simultaneously on lines 55 and 56. The limit switches 36, 37 are connected in an obvious manner to interrupt the drive circuit if either limit is reached. This stops motor 20, but the direction of rotation is not reversed until the signal from sensor 25 changes to the opposite indication.

In the power supply unit 45, a regulator 80 is connected as shown to provide the eight volt energizing voltage on line 46. In the illustrated embodiment, a 7800 series three-terminal voltage regulator was utilized and connected as shown. This provides a voltage of 5 volts on line 47 to the programmable voltage supply circuit 48. Circuit 48 includes a pair of op amps 81, 82, and transistors 83, 84. In the illustrated arrangement the adjustable voltage supply 48 is a unity gain voltage buffer. It is connected to provide a first (higher) voltage level on line 50 at engine speeds above 1,100 rpm, to effect rotation of the servo motor 20 at about 2 rpm under these conditions. Below 1,100 rpm, when the engine is idling or at a light load, the voltage supply 48 provides a reduced voltage over line 50 which rotates motor 20 at about 1 rpm. Other types of programmable or adjustable power supplies can be positioned in place of the circuit 48, so long as it provides an adjustable output voltage on line 50 to regulate the displacement rate of the control actuator.

The voltage level adjust circuit 52 determines the level of voltage which the programmable voltage supply provides over line 50 to the bridge inverter. The circuit was designed to provide a "1" or higher-voltage signal on line 85 when the frequency of the pulses on input line 33 denoted an engine speed at or over 1,100 rpm, and a "0" or low-level voltage when the engine speed was below this value. Those skilled in the art will readily appreciate that the "1" signal effectively places the resistor 86 in parallel with the resistor 87, in a voltage divider completed by resistor 88. Without a "1" signal on line 85, the input voltage divider is comprised only of resistors 87 and 88. The "1" signal causes op amp 81 to switch, turning on transistor 83 and likewise turning on transistor 84 to change the voltage level on line 50 and correspondingly change the energization level of servo motor 20.

The semiconductor 90 shown in block form in the input circuit was a dual "D" type 4013 circuit, connected as shown by the legends. This circuit receives pulses over line 81 which are derived from the ignition coil or other source. Each incoming pulse on line 33 gates on transistor 92, which in turn forward-biases transistor 93 and provides the pulse signal over line 81 to the clock or $C_L$ input connection. Each time the pulse appears on line 91, the same signal gates on transistor 94 to complete a discharge path for the capacitor 95. Normally charging current for the capacitor flows from the positive energizing potential over resistor 96, through capacitor 95 to ground. In the event no pulse is received to discharge the capacitor 95, a sufficient potential will build up to turn on the thyristor 97, which fires and passes a reset pulse over line 98 to the reset or R terminal of the circuit 90. When the reset pulse occurs, the output of circuit 90 switches to a low voltage or "0" condition on line 85. Thus this condition indicates the low-speed or under 1,100 rpm condition, effectively removing resistor 86 from the voltage divider circuit which regulates the switching of op amp 81. Selection of the circuit values for capacitor 95 and resistor 96 determines the engine speed which must be maintained, indicated by the frequency of the pulses received over line 33, to provide the "1" signal on line 85 and the higher level voltage on line 50.

TECHNICAL ADVANTAGES

The present invention represents an advance over the previous electronic carburetor control systems because there is no stage for integrating the control signal before using it to drive the control actuator. By continually driving the actuator, the integration is in effect accomplished in the servo motor itself. By providing a lower level of energization, and hence the slower actuator speed during warm-up extensive hunting of the system is obviated. The input circuit provides simple and accurate transition from operation below a preset speed to a different rate of actuator displacement when the engine is above this preset speed. Those skilled in the art will readily appreciate other functions can be incorporated into the system, in a manner apparent from the explanation given above.

While only a particular embodiment of the invention has been described and claimed herein, it is apparent that various modifications and alterations of the invention may be made. It is therefore the intention in the appended claims to cover all such modifications and alterations as may fall within the true spirit and scope of the invention.

What is claimed is:

1. A control system for regulating the air/fuel ratio of the mixture delivered to an engine in which virtually all of the gasoline is burned, and the exhaust gas is discharged through an exhaust conduit, comprising:

a sensor positioned to contact the exhaust gas and develop an electrical control signal which varies as a function of the proportion of at least one component gas in the discharged exhaust gas;

a control actuator, positioned for movement to regulate the air/fuel ratio; and a control circuit, connected to receive said control signal and including switching means connected to displace the control actuator continually in a direction which is a function of that signal, driving the air/fuel ratio sequentially toward richer and leaner mixtures in accordance with the instantaneous value of the control signal, thus producing an optimum stoichiometric value of the air/fuel ratio, an adjustable power supply coupled to said switching means for regulating the displacement rate of the control actuator, and means connected to supply an engine-speed-indicating signal to the adjustable power supply, so that the rate of change of the air/fuel ratio is a function of engine speed.

2. A control system as claimed in claim 1, in which said control circuit includes means for displacing the control actuator toward a richer or leaner mixture position in response to receipt of a condition-indicating signal.

3. A control system as claimed in claim 2, and having means for providing an engine temperature indicating signal, as said condition-indicating signal, to the control circuit.

4. A control system for an engine which burns combustible gas received from a carburetor having an element which is adjustable to regulate the air/fuel ratio of the mixture delivered to the engine, with the products of combustion being discharged through an exhaust conduit, comprising:

a sensor, having a portion suitable for positioning in the exhaust conduit, to develop an electrical control signal varying in relation to the amount of at least one component gas in the discharged exhaust gas mixture;

a control actuator adapted to be coupled to the adjustable element of the carburetor, and connected to receive an electrical regulating signal to regulate both the direction and the rate of actuator movement and correspondingly regulate movement of the element to change the air/fuel ratio; and a control circuit, coupled between the sensor and the control actuator, including means for establishing a reference signal, and means for continually comparing the control signal received from the sensor with the reference signal to provide the regulating signal for driving the control actuator in a direction to provide either a richer or leaner mixture, which control circuit continually functions and continually drives the actuator in one of two directions, thus establishing an average position of the carburetor adjustable element to produce a stoichiometric value of the air/fuel ratio, switching means coupled to the control actuator to regulate the direction of control actuator movement as a function of the sense of the regulating signal and also to regulate the rate of control actuator movement, an adjustable power supply coupled to said switching means for modifying the amplitude of said regulating signal and thus controlling the rate of control actuator movement, and means connected to supply an engine-speed-indicating signal to the adjustable power supply so that the rate of change of the air/fuel ratio is a function of engine speed.

5. A control system for an engine which burns combustible gas received from a fuel delivery device having an element which is adjustable to regulate the air/fuel ratio of the mixture delivered to the engine, with the products of combustion being discharged through an exhaust conduit, comprising:

a sensor, having a portion suitable for positioning in the exhaust conduit, to develop an electrical control signal varying in relation to the amount of at least one component gas in the discharged exhaust gas mixture;

a control actuator adapted to be coupled to the adjustable element of the fuel delivery device, and connected to receive an electrical regulating signal to regulate both the direction and the rate of actuator movement and correspondingly regulate movement of the element to change the air/fuel ratio; and a control circuit, coupled between the sensor and the control actuator, including means for establishing a reference signal, and means for continually comparing the control signal received from the sensor with the reference signal to provide the regulating signal for driving the control actuator in a direction to provide either a richer or leaner mixture, which control circuit continually functions and continually drives the actuator in one of two directions, thus establishing an average position of the adjustable element in the fuel delivery device to produce a stoichiometric value of the air/fuel ratio, switching means coupled to the control actuator to regulate the direction of control actuator movement as a function of the sense of the regulating signal and also to regulate the rate of control actuator movement, an adjustable power supply coupled to said switching means for modifying the amplitude of said regulating signal and thus controlling the rate of control actuator movement, and means connected to supply an engine-speed-indicating signal to the adjustable power supply so that the rate of change of the air/fuel ratio is a function of engine speed.

* * * * *